US005140882A

United States Patent [19]

Hyder

[11] Patent Number: 5,140,882

[45] Date of Patent: Aug. 25, 1992

[54] ASSEMBLY FOR SEVERING SHEET MATERIAL

[75] Inventor: L. Edward Hyder, Huntington, Ind.

[73] Assignee: Peerless Machine & Tool Corporation, Marion, Ind.

[21] Appl. No.: 733,601

[22] Filed: Jul. 22, 1991

Related U.S. Application Data

[62] Division of Ser. No. 475,816, Feb. 6, 1990, Pat. No. 5,052,992.

[51] Int. Cl.[5] ..... B26D 1/04

[52] U.S. Cl. ..... 83/620; 83/694; 83/955

[58] Field of Search ..... 83/955, 694, 620

[56] References Cited

U.S. PATENT DOCUMENTS

| | | | |
|---|---|---|---|
| 402,381 | 4/1889 | Aiken | 83/694 |
| 490,777 | 1/1893 | Thethewey | 83/955 X |
| 856,719 | 6/1907 | Nagle | 83/694 |
| 1,146,475 | 7/1915 | Carrolley | 83/694 |
| 1,656,794 | 1/1928 | Messenger | 83/40 |
| 1,663,092 | 3/1928 | Parys | 83/694 |
| 1,866,855 | 7/1932 | Kirsten | 83/694 |
| 2,006,417 | 7/1935 | Topping | 164/17 |
| 2,047,322 | 7/1936 | Hazelton | 83/955 |
| 2,127,131 | 8/1938 | Moeller | 493/61 |
| 2,145,405 | 1/1939 | Schermerhorn | 83/694 |
| 2,343,253 | 3/1944 | Clark | 29/148 |
| 2,378,041 | 6/1945 | Sebell | 29/148 |
| 2,525,401 | 10/1950 | Dehn | 83/694 X |
| 2,600,834 | 6/1952 | Blair | 164/17 |
| 2,851,933 | 9/1958 | Bradford, Jr. et al. | 493/61 |
| 2,997,927 | 8/1961 | Carson | 493/59 |
| 3,388,582 | 6/1968 | Wesstrom et al. | 72/335 |
| 4,149,841 | 4/1979 | Patterson | 425/398 |
| 4,246,223 | 1/1981 | Patterson | 264/292 |
| 4,328,665 | 5/1982 | Taubert et al. | 59/88 |
| 4,637,811 | 1/1987 | Fortney | 493/167 |
| 4,646,601 | 3/1987 | Borzym | 83/385 |
| 4,691,604 | 8/1987 | Carmichael | 83/164 |
| 4,778,439 | 10/1988 | Alexander | 493/169 |
| 5,052,992 | 10/1991 | Hyder | 493/62 |

*Primary Examiner*—Frank T. Yost
*Assistant Examiner*—Kenneth E. Peterson
*Attorney, Agent, or Firm*—Barnes & Thornburg

[57] ABSTRACT

A cut and score die apparatus is provided for progressively converting a sheet of material into blanks. The apparatus includes a punching section for punching scrap material from the sheet of material to define an array of interconnected blanks arranged in a grid of rows and columns on the sheet of material. A scoring section is provided for simultaneously scoring a first predetermined pattern on a trailing portion of a first row of blanks and a second predetermined pattern on the leading portion of a second, succeeding row of blanks on the sheet of material. A blanking section is also provided for piercing the sheet of material in a predetermined pattern to cut blanks from the sheet of material without producing any additional scrap material.

3 Claims, 3 Drawing Sheets

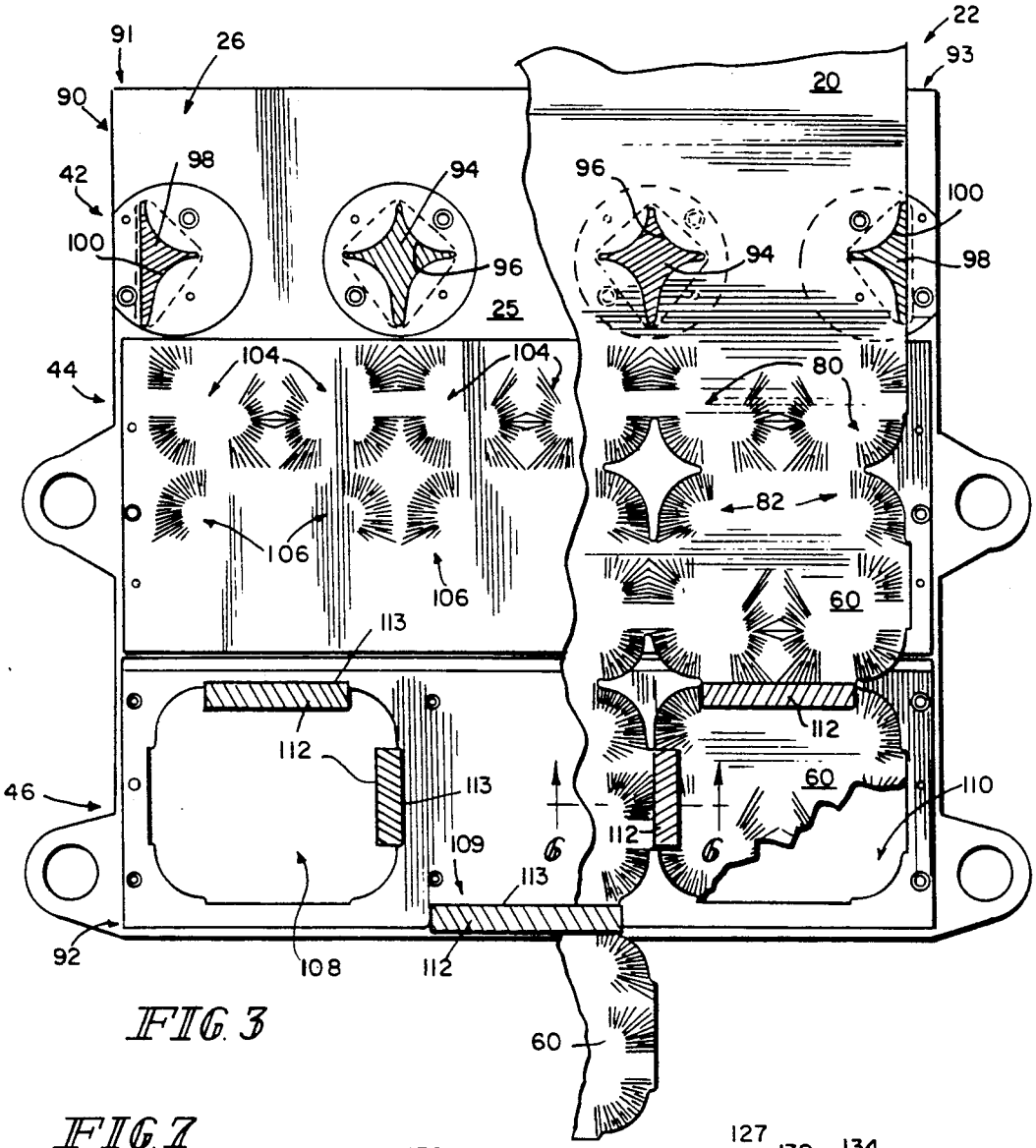
FIG. 3
FIG. 7
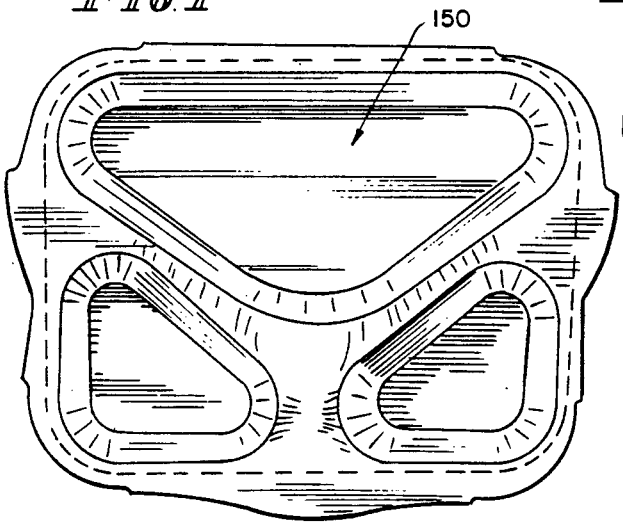
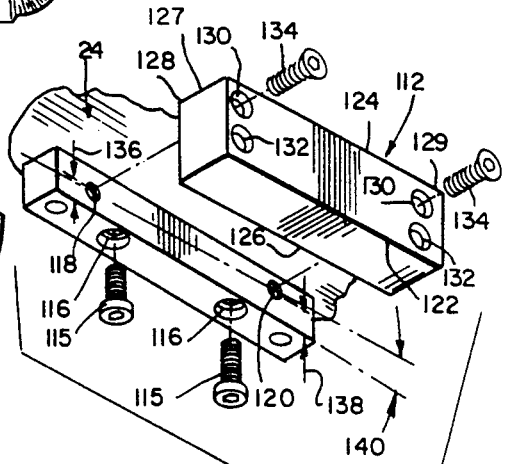
FIG. 4

ASSEMBLY FOR SEVERING SHEET MATERIAL

This is a division of application Ser. No. 07/475,816 filed Feb. 6, 1990, now U.S. Pat. No. 5,052,992.

BACKGROUND AND SUMMARY OF THE INVENTION

The present invention relates to a die system for producing blanks from a sheet of material. More particularly, the present invention relates to an apparatus and method for punching corner scrap material from the sheet of material in a predetermined pattern to define a grid of blanks on the sheet of material, scoring the blanks in a predetermined pattern, and then severing the sheet of material to form the blanks without producing any additional scrap material.

In recent years, the popularity of heat-and-serve foods has increased. With the increased popularity of these heat-and-serve foods, the need for disposable trays made from inexpensive materials such as paper has also increased. These disposable trays are formed by stamping blanks of material inside a die press.

One problem associated with the production of blanks from a sheet of material is that a large amount of scrap material is produced. Therefore, a substantial amount of the sheet of material is wasted. The cost of this wasted material is substantial, especially for a continuously running blank-forming device.

Blanks are often unevenly or nonuniformly scored by conventional blank forming devices. During formation of trays from scored blanks, blanks with unequal or nonuniform scoring are more likely to be torn as they are stamped between male and female dies of the die press.

Punches used in conventional blank forming devices must be replaced when they become worn. In addition, replacing or sharpening the punches can be difficult, time consuming, and expensive. Therefore, a conventional blank forming machine must be shut down for a substantial time during replacement or sharpening of the punches.

One object of the present invention is to reduce the amount of scrap material generated during the process of cutting a sheet of material to provide a plurality of separate blanks suitable to be stamped in a die press to convert each blank into a disposable tray.

Another object of the present invention is to provide uniform scoring on a surface of the blank to facilitate the formation of compartments in the blank and to reduce the likelihood that the blank will be torn during stamp-forming of the blank in a die press.

Yet another object of the present invention is to provide a mechanism for severing the sheet of material, which mechanism is less expensive to manufacture and easier to maintain than conventional punches of the type used to form blanks from a sheet of material.

According to the present invention, a die system is provided for producing blanks from a sheet of material. According to one aspect of the invention, the die system includes means for punching corner scrap material from the sheet of material to define an array of interconnected blanks arranged in a grid of rows and columns in the sheet of material. The die assembly also includes blanking means situated downstream from the punching means for piercing the sheet of material in a predetermined pattern to cut blanks of a predetermined size from the sheet of material without producing any additional scrap material.

The blanking means includes a die plate having a support surface for supporting the sheet of material. The die plate is formed to include first and second blank discharge apertures positioned in a spaced apart relation. The first and second blank discharge apertures are aligned with a single row of blanks and alternate columns of blanks in the sheet of material.

This aspect of the invention advantageously reduces the amount of scrap material produced during formation of blanks from a sheet of material. Because the production of blanks from sheet material is typically a high volume job in which the blank forming machine runs continuously, the reduction in the amount of paper wasted per year by the present invention is substantial. This reduction in the amount of paper wasted translates directly into cost savings during the blank production process.

According to another aspect of the present invention, the die assembly includes means for simultaneously scoring a trailing portion of a first row of blanks and a leading portion of a succeeding row of blanks on the sheet of material moving through the die assembly. The scoring means scores a first predetermined pattern only on the trailing portion of the first row of blanks while simultaneously scoring a second predetermined pattern only on the leading portion of the succeeding row of blanks.

The scoring means is located between the punching means and the blanking means in a center portion of the die assembly spaced apart from an entry region and an exit region of the die assembly. By locating the scoring means in substantially the center portion of the die assembly, the scoring means advantageously provides more uniform scoring on the blanks than conventional blank-forming devices. This uniform scoring facilitates formation of trays from the blanks by a die press and reduces the risk that the blanks will be torn by the die press.

According to yet another aspect of the invention, the die assembly includes first and second die shoes and means for providing reciprocating movement of the first and second die shoes relative to each other. The die system includes a first shearing edge situated on the second die shoe and a knife member mounted to the first die shoe. The knife member has a second shearing edge for engaging the first shearing edge to cut the sheet of material. The knife member is mounted on the first die shoe so that the second shearing edge is oriented at a predetermined, nonparallel angle with respect to the first shearing edge so that "scissors" means is created by the first and second shearing edges for severing the sheet of material upon relative movement of the first and second die shoes.

The knife member is formed to include a plurality of cutting edges and is mounted to the first die shoe to position a selected one of the cutting edges over the sheet of material to sever the sheet of material upon relative movement of the first and second die shoes. Advantageously, when the selected cutting edge that is positioned over the sheet of material becomes dull, the knife can be rotated relative to the die shoe on which it is mounted to position another selected cutting edge over the sheet of material so that it can be used to sever the sheet of material. Therefore, the amount of machine down time required for maintenance is reduced by this aspect of the invention.

According to still another aspect of the present invention, a method is provided for progressively converting a sheet of material moving along its length in a downstream direction through a die assembly into a plurality of sets of blanks. The method includes the steps of punching corner scrap material from the sheet of material to define an array of interconnected blanks arranged in a grid of rows and columns on the sheet of material. Each row of blanks has a leading portion adjacent to a trailing portion of a downstream row and a trailing portion adjacent to a leading portion of an upstream row. The method also includes the step of simultaneously scoring a trailing portion of a first row of blanks and a leading portion of an adjacent succeeding row of blanks at the same time. The method further includes the step of piercing the sheet of material in a predetermined pattern to form blanks of a predetermined size from the sheet of material without producing any additional scrap material.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 3 is a sectional view taken through the die assembly of FIG. 1 when the top and bottom die shoes are in an engaged position with portions broken away;

FIG. 4 is a perspective view of a knife member for severing the sheet of material to form the blanks and a mounting block for securing the knife member to the top die shoe;

FIG. 7 is a plan view illustrating a compartment tray formed from a blank produced by the present invention.

DETAILED DESCRIPTION OF THE DRAWINGS

Figure 1:
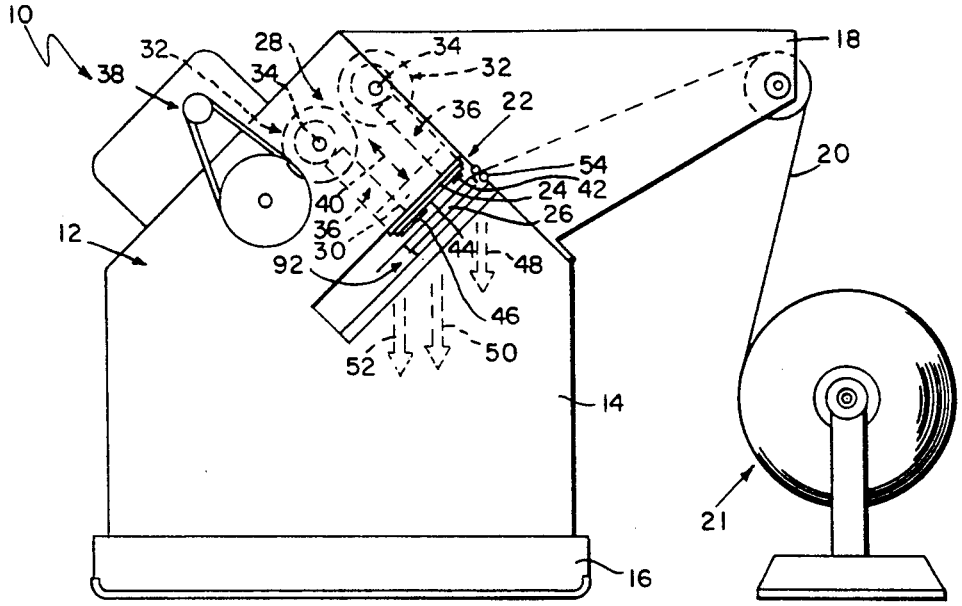
FIG. 1 is a side elevation view of a preferred embodiment of the present invention with portions broken away to reveal a die assembly including top and bottom inclined die shoes.

Referring now to the drawings, FIG. 1 diagrammatically illustrates a cut and score die apparatus 10 of the present invention. The apparatus 10 includes a press section 12 supported in an inclined position by side frame 14 fixed to skids 16. A feed assembly 18 draws a continuous sheet of blanking material 20 from a conventional roll storage unit 21 into the press section 12 for processing.

The press section 12 includes a die assembly 22 in which the sheet of blanking material 20 is progressively converted into blanks. Die assembly 22 includes a top die shoe 24 and a bottom die shoe 26. Drive means 28 for moving the top die shoe 24 relative to bottom die shoe 26 includes a reciprocating platen 30 and a pair of gear means 32. The gear means 32 are mounted on rotatable shafts 34 and are coupled to reciprocating platen 30 by connecting means 36. A motor 38 is included for rotating the gear means 32 to reciprocate the reciprocating platen 30 alternately in the direction of double headed arrow 40 in a conventional way.

Die assembly 22 includes an upstream punching section 42 for removing scrap material from the sheet of material 20 in a predetermined pattern to form a grid of adjacent, abutting blanks 60 arranged in rows and columns on the sheet of material 20. Die assembly 22 also includes a scoring section 44 sp aced apart from the punching section 42 in the downstream direction. Scoring section 44 is located in substantially the center of top and bottom die shoes 24 and 26 equally spaced apart from an upstream end 90 and a downstream end 92 of the die assembly 22 (See FIG. 3). Die assembly 22 further includes cutting section 46 for severing the sheet of material to form blanks 60 from the sheet of material 20.

Scrap material punched from the sheet of material 20 in punching section 42 falls through apertures (not shown) formed in bottom die shoe 26 in the direction of arrow 48 due to gravity. A first pair of blanks 60 severed from the sheet of material 20 fall through blank discharge apertures 108, 110 (See, FIG. 3) formed in the bottom die shoe 26 in the direction of arrow 50. A center blank 60 severed from sheet of material 20 falls off the downstream end 92 of die assembly 22 in the direction of arrow 52 due to gravity. A pair of pinch rollers 54 is used to index the sheet of material 20 a predetermined distance in the downstream direction after each reciprocating movement of top die shoe 24 with respect to bottom die shoe 26.

Figure 2:
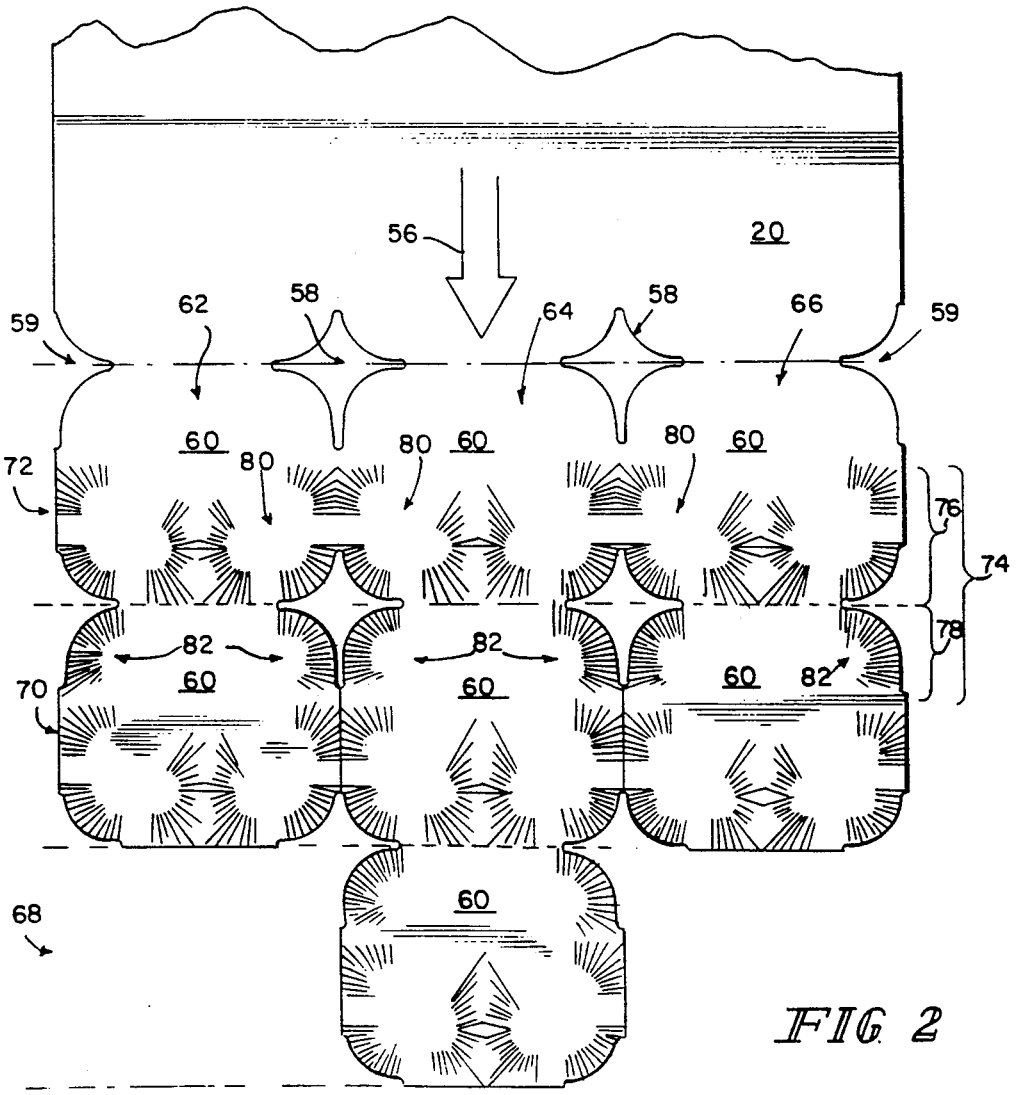
FIG. 2 is a plan view of the sheet of material advancing through the die assembly illustrating a grid of blanks aligned in rows and columns formed by the punching means and a predetermined scored pattern on the leading and trailing edges of the rows of blanks formed by the scoring means.

The configuration of the sheet of material 20 moving through the die assembly 22 is shown in FIG. 2. The sheet of material 20 moves in a downstream direction illustrated by arrow 56. The punching section 42, scoring section 44, and blanking section 46 shown in FIG. 1 act simultaneously on different portions of the sheet of material 20 as it moves in the downstream direction over the bottom die shoe 26 and underneath the sheet-stamping sections 42, 44, and 46 appended to the top die shoe 24.

Punching section 42 pierces the sheet of material 20 to remove corner scrap from regions 58 and 59 of the sheet of material 20. By removing sections 58 from sheet of material 20 the punching section 42 forms corner portions of four adjacent blanks. By removing material from sections 59, the punching section 42 forms the corner portions between two adjacent blanks 60. The punching section 42 defines a grid of blanks 60 on the sheet of material 20. The blanks 60 are aligned in a series of three separate columns 62, 64, and 66 of blanks 60 on the sheet of material 20 as seen in FIG. 2. As the sheet of material 20 advances in a downstream direction 56 through die assembly 22, a plurality of adjacent strips or rows 68, 70, and 72 of blanks 60 extending across the width of the sheet of material 20 are defined. Blanks 60 in column 64 abut blanks 60 on all four sides. Blanks 60 situated in columns 62 and 66 abut adjacent blanks on three sides.

As the punching section 42 removes the scrap material from portions 58 and 59, the scoring section 44 of die assembly 22 scores a region 74 on the sheet of material 20. Scoring section 44 is configured to score a predetermined pattern 80 only on a leading portion 76 of a trailing row 72 of blanks 60 while simultaneously scoring a second predetermined pattern 82 only on a trailing portion 78 of a leading row 70 of blanks 60.

During operation of die assembly 22, the top die shoe 24 moves downward to engage bottom die shoe 26 and reach the position shown in FIG. 3. The sheet of material 20 is supported on support surface 25 of bottom die shoe 26. Die assembly 22 includes first and second side portions 91 and 93. Die assembly 22 also includes an upstream end or entry region 90 and a downstream end portion or exit region 92.

The punching section 42 includes male die members 94 and 98 having the shape shown in FIG. 3. Male die members 94 and 98 are connected to the top die shoe 24 and engage female dies 96 and 100, respectively, formed on bottom die shoe 26 upon movement of the top die shoe 24 toward bottom die shoe 26. Male die members 94 and female dies 96 cooperate to punch corner scrap from regions 58 of the sheet of material 20. Male die members 98 and female dies 100 cooperate to punch corner scrap from regions 59 of the sheet of material 20. Male dies 94 and 98 and female dies 96 and 100, respectively, cooperate to define means for punching corner scrap from the sheet of material 20 to define an array of interconnected blanks 60 arranged in a grid on rows 68, 70, and 72 and columns 62, 64, and 66 on sheet of material 20.

Scoring section 44 is located on a center portion of the top and bottom die shoes substantially equally spaced between the upstream and downstream ends 90 and 92 in a spaced apart relation from the entry region and the exit region. The position of the scoring section 44 can vary depending upon the style and size of blank 60 being scored. Scoring the sheet of material 20 requires more tonage of pressure than punching scrap with punching section 42 or severing blanks 60 with blanking section 46. By situating the scoring section 44 in substantially the center of the top and bottom die shoes 24 and 26, more uniform scoring is provided on the sheet of material 20 upon reciprocating movement of top and bottom die shoes 24 and 26. This uniform scoring facilitates formation of compartment trays 150 such as the one illustrated in FIG. 7 from the blanks 60. The uniform scoring reduces the likelihood that the paper blanks 60 will tear during formation of the compartment trays 150.

Scoring section 44 includes a raised pattern 104 and 106 formed on top die shoe 24. Raised pattern 104 scores section 80 on blanks 60, and raised pattern 106 scores section 82 on blanks 60. Scoring section 44 provides means for simultaneously scoring a trailing portion 78 of a leading row 70 of blanks 60 and a leading portion 76 of a trailing row 72 of blanks 60 at the same time.

As shown in FIG. 3, the blanking section 46 includes first and second blank discharge apertures 108 and 110, respectively. First and second blank discharge apertures 108 and 110 are situated in a spaced apart relation near the exit region 92 of die assembly 22. First and second blank discharge apertures 108 and 100 are aligned with a single row of blanks 60 and with alternate columns of blanks 60 on the sheet of material.

The knife members 112 attached to top die shoe 24 engage shearing edges 113 on bottom die shoe 26 to cut the sheet of material 20 to form blanks 60 over first and second blank discharge apertures 108 and 110 from row of blanks 70 shown in FIG. 2. Two knife members 112 are used to cut blanks over each of the first and second blank discharge apertures 108 and 110. An additional knife member 112 engages an additional shearing edge 113 as indicated at location 109 to cut a blank 60 from the center column 64 in a leading row of blanks 68 simultaneously with the blanks 60 being formed from row 70 in blank discharge apertures 108 and 110.

Knife members 112 and shearing edges 113 cut the sheet of material 20 between adjacent columns 62, 64 and 66 and between adjacent rows 68, 70 and 72. Knife members 112 and shearing edges 113 provide means for piercing the sheet of material 20 to cut blanks 60 without producing any additional scrap material other than the scrap material produced by punching section 42. Therefore, there is a substantial reduction in the amount of scrap material over conventional blank-forming devices.

Figure 5:
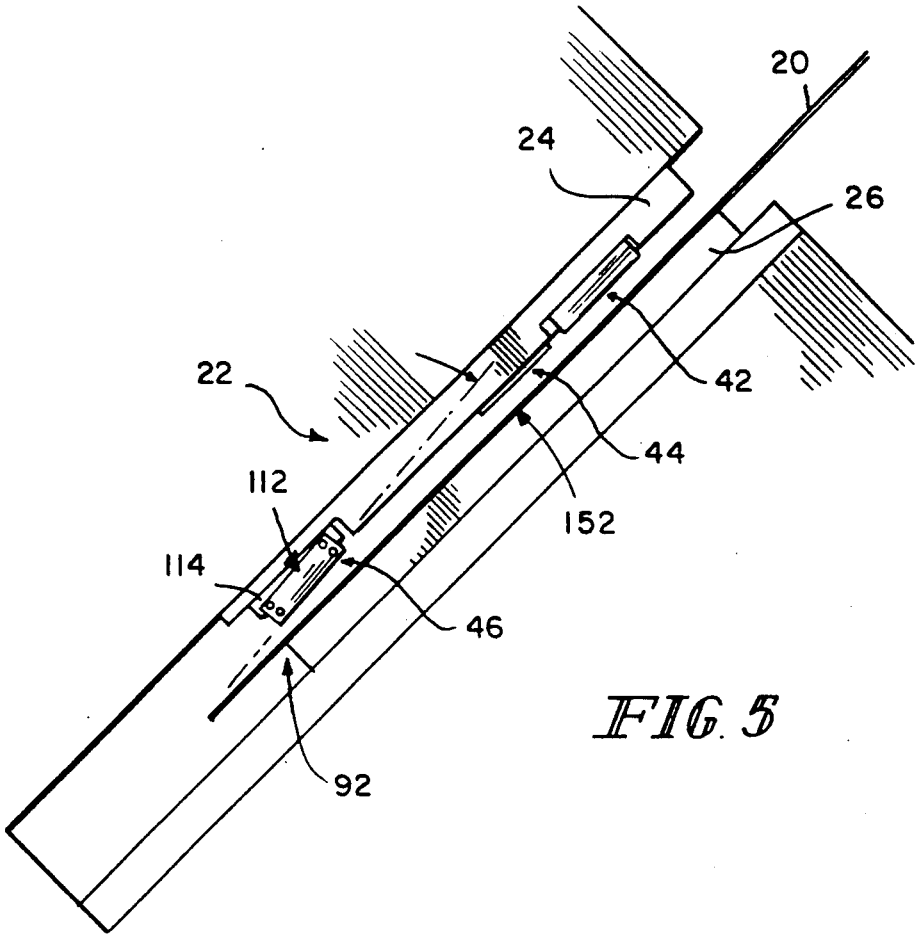
FIG. 5 is an enlarged view of the die assembly shown in FIG. 1 illustrating the alignment of a cutting edge of the knife member with respect to a cutting edge on the bottom die shoe to provide scissors for severing the sheet of material.
Figure 6:
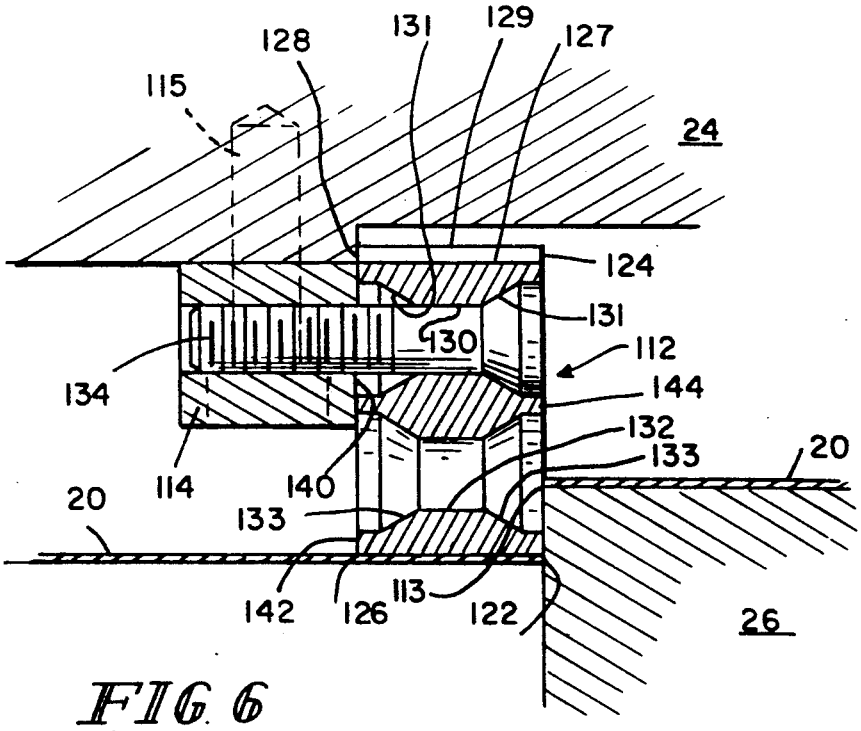
FIG. 6 is a sectional view taken through lines 6—6 of FIG. 3 illustrating the connection between the mounting block and the top die shoe and the knife member and the mounting block as the knife member severs the sheet of material to form a blank.

The knife member 112 of the present invention is shown in more detail in FIGS. 4–6. FIG. 4 illustrates the knife member 112 which has the shape of a right rectangular prism. Knife member 112 is coupled to the top die shoe 24 by a mounting block 114. Mounting block 114 provides means for mounting knife member 112 to top die shoe 24 to position a selected cutting edge 122, 124, 126, and 128 over the sheet of material 20 to sever the sheet of material 20 upon relative movement of the top and bottom die shoes 24 and 26. Mounting block 114 includes a pair of apertures 116 for receiving suitable fasteners 115 to secure the mounting block 114 to top die shoe 24. Mounting block 114 also includes a first aperture 118 and a second aperture 120 for receiving fasteners 134 to secure knife member 112 to mounting block 114..

Fasteners 134 extend through a pair of apertures 130 formed in knife member 112 to secure knife member 112 to mounting block 114. Knife member 112 includes four elongated corners which provide for cutting edges 122, 124, 126 and 128. Any one selected cutting edge 122, 124, 126 or 128 can be used in cooperation with shearing edges 113 to sever the sheet of material 20. A second pair of mounting apertures 132 permits knife member 112 to be rotated relative to mounting block 114 and secured to the mounting block 114 in a different orientation to position a different selected cutting edge 122, 124, 126 or 128 over the sheet of material 20. Fasteners 134 can also extend through the second pair of apertures 132 and into apertures 118 and 120 of mounting block 114.

Aperture 120 is spaced a greater distance away from a bottom edge 135 of mounting block 114 than the position of aperture 118. As shown in FIG. 4, the distance illustrated by dimension 138 is greater than the distance illustrated by dimension 136. Mounting block 114 is mounted to align bottom edge 135 of mounting block 114 parallel to top die shoe 24. Therefore, when knife member 112 is coupled to mounting block 114, the selected cutting edge 122, 124, 126, or 128 is situated at a predetermined, nonparallel angle with respect to the top die shoe 24 as illustrated by angle 140 in FIG. 4. Angle 140 is preferably about ½ degree.

The angle 152 of the selected cutting edge 122 of the knife member 112 with respect to the support surface 25 for supporting the sheet of material 20 on bottom die shoe 26 is best shown in FIG. 5. Bottom die shoe 26 is formed to include a shearing edge parallel to the support surface 25. Upon reciprocating movement of the top and bottom die shoes 24 and 26, the selected shearing edge 122 of the knife member 112 engages the shearing edge 113 on bottom die shoe 26 to severe the sheet of material 20. Because the knife member 112 is situated a predetermined, nonparallel angle with respect to the bottom die shoe 24, the selected shearing edge 122 of the knife member 112 and the shearing edge 113 of die shoe 26 provide scissors means for cutting the sheet of material 20.

The connection of knife member 112 to the top die shoe 24 by mounting block 114 is illustrated in FIG. 6. Both pairs of mounting apertures 130 and 132 on knife member 112 are countersunk on opposite sides of knife member 112 so that knife member 112 can be rotated 180° or turned upside-down to position another one of the selected cutting edges 122, 124, 126 and 128 in a proper position over the bottom die shoe 26 for severing the sheet of material 20.

As shown in FIG. 6, beveled sections 131 are formed on opposite sides 142 and 144 of knife member 112 for each mounting aperture 130. Beveled sections 133 are also formed on opposite sides 142 and 144 of knife member 112 for each mounting aperture 132. One side face 142 of knife member 112 abuts the side face 140 of mounting block 114. Mounting block 114 is positioned a predetermined distance away from shearing edge 113 on lower die shoe 26 so that the knife member 112 is positioned properly for severing the sheet of material 20 when aligned in any of its four orientations to position any of the selected cutting edges 122, 124, 125, or 128 over the sheet of material 20. Therefore, the cutting edges 122, 124, 126 and 128 can be sharpened several times without changing the position of mounting block 114 to maintain the proper position for cutting edges 122, 124, 126, and 128 for engaging the cutting edge 113 on bottom die shoe 26.

Knife members 112 can be rotated quickly to reduce maintenance down time for the die assembly 22. Because knife member 112 includes four cutting edges 122, 124, 126, and 128, the life expectancy of each knife member 112 is greater than the life expectancy of a normal punch used to produce blanks in conventional blank forming devices. Knife members 112 are also easier to sharpen than conventional punches.

During operation of the cut and score die apparatus 10, the method of producing the blanks 60 from the sheet of material 20 proceeds as follows. A feed assembly 18 including pinch rollers 54 draws a sheet of material 20 from a roll storage unit 21 through die assembly 22. Punching section 42 punches corner scrap material from regions 58 and 59 on the sheet of material 20 to define an array of interconnected blanks 60 arranged in a grid of rows 68, 70, and 72 and columns 62, 64, and 66 on the sheet of material. The scoring section 44 simultaneously scores a trailing portion 78 of a leading row 70 of blanks 60 in a first predetermined pattern 82 and a leading portion 76 of an adjacent succeeding row 72 of blanks 60 in a second predetermined pattern 80. Blanking means 46 pierces the sheet of material 20 in a predetermined pattern to form blanks 60 from the sheet of material 20 without producing any additional scrap material.

After the sheet of material 20 shown in FIG. 2 is indexed forward, the blanking section 46 pierces the sheet of material 20 over first and second blank discharge apertures 108 and 110 to form blanks 60 from the first column 62 and the third column 66 along row 70 on sheet of material 20. Blanking section 46 also simultaneously cuts blank 60 from column 64 and row 68. Therefore, during each reciprocating movement of the top and bottom die shoes 24 and 26, three blanks 60 are formed. By severing the sheet of material between adjacent columns 62, 64, and 66 and adjacent rows 68, 70, and 72, blanking section 46 produces blanks 60 without producing any additional scrap material. By providing a blanking section 46 which severs the sheet of material 20 to form blanks 60 without producing additional scrap material, paper savings of about 6% to 8% over conventional blank-forming devices is obtained.

Although the invention has been described in detailed with reference to a certain preferred embodiment, variations and modifications exist within the scope and spirit of the invention as described and defined in the following claims.

What is claimed is:

1. An assembly for severing a sheet of material moving through a die assembly including first and second die shoes and a means for providing linear reciprocating movement of the first and second die shoes relative to each other, the assembly comprising a first shearing edge situated on the second die shoe, a knife member having a second shearing edge for engaging the first shearing edge to sever the sheet of material upon relative movement of the first and second die shoes, a mounting block having plural fasteners for mounting the knife member to the first die shoe to orient the second shearing edge at a predetermined, nonparallel angle with respect to the first shearing edge so that scissors means is created by the first and second shearing edges wherein the knife member includes a plurality of second shearing edges and the mounting means positions a selected one of the second shearing edges over the sheet of material to sever the sheet of material upon relative movement of the first and second die shoes, wherein the knife member has the shape of a right rectangular prism having four faces joined at four corners, the corners providing the second shearing edges, wherein the knife member has a first and second set of cooperating fastener means that are fastenable with the plural fasteners on the mounting block to orient the knife member at the nonparallel angle, wherein only the first set of cooperating fastener means is used when one of the second shearing edges is in a cutting position, and only the second set of cooperating fastener means is used when another of the second shearing edges is in the cutting position.

2. An assembly for severing a sheet of material moving through a die assembly including first and second die shoes and means for providing reciprocating linear movement of the first and second die shoes relative to each other, the assembly comprising a first cutting member having a plurality of cutting edges, and a mounting block for mounting the first cutting member to the first die shoe to position a selected one of the cutting edges over the sheet of material to sever the sheet of material upon relative movement of the first and second die shoes, said mounting block having fastener means for attaching the cutting member to the mounting block at an angle with respect to a second cutting member on the second die shoe, wherein the first cutting member is formed to include first mounting apertures spaced a predetermined distance apart for cooperating with the fastener means to secure the cutting member to the first die shoe, and wherein the first cutting member is formed to include additional mounting apertures spaced the same predetermined distance apart as the first mounting apertures and offset from the first mounting apertures, the additional mounting apertures being configured to cooperate with the fastener means to permit the cutting member to be rotated to align another of the cutting edges of the first cutting member over the sheet of material and at the same angle as the first cutting member is aligned with the second die shoes.

3. The assembly of claim 2 wherein there is at least two mounting apertures on the cutting member and wherein one of at least two apertures is located closer to a cutting edge of the first cutter than another of the at least two mounting apertures to angle the first cutting member to the second cutting member.

* * * * *